US006769993B1

(12) United States Patent
Lasalandra

(10) Patent No.: US 6,769,993 B1
(45) Date of Patent: Aug. 3, 2004

(54) GOLF TRAINING GAME

(76) Inventor: Frank Lasalandra, 15-20 Fourth St., Fairlawn, NJ (US) 07410

( * ) Notice: Subject to any disclaimer, the term of this patent is extended or adjusted under 35 U.S.C. 154(b) by 0 days.

(21) Appl. No.: 10/178,833

(22) Filed: Jun. 25, 2002

(51) Int. Cl.[7] ..... A63B 69/36
(52) U.S. Cl. ..... 473/193; 473/160
(58) Field of Search ..... 473/150–166, 473/170–172, 181, 193–197

(56) References Cited

U.S. PATENT DOCUMENTS 2,678,823 A * 5/1954 Hugman ..... 52/126.6
3,427,030 A * 2/1969 Ward ..... 473/159
3,558,140 A * 1/1971 Romeo ..... 473/164
3,601,406 A * 8/1971 Giusti ..... 473/160
3,743,295 A * 7/1973 Flowers ..... 473/171
4,125,865 A * 11/1978 Mohammadioun ..... 360/32
4,244,576 A * 1/1981 Mosier et al. ..... 473/159
5,042,813 A * 8/1991 Huang ..... 473/153
5,409,230 A * 4/1995 Dunaway et al. ..... 473/161
5,549,302 A * 8/1996 Lapsker et al. ..... 473/416
5,655,972 A * 8/1997 Heitzman ..... 473/172
5,855,522 A * 1/1999 Bevan ..... 473/160
5,863,256 A * 1/1999 MacLean et al. ..... 473/160
6,569,027 B2 * 5/2003 Florian ..... 473/160

* cited by examiner

*Primary Examiner*—Mark S. Graham

(57) ABSTRACT

A golf training game for improving one's golf game. The golf training game includes a height-adjustable base support member being disposed upon a ground; and also includes a putting mat being disposed upon the height-adjustable base support member; and further includes a cup being disposed in and depending from the putting mat; and also includes a flag member being removably disposed in the cup; and further includes a fairway mat being removably disposed upon the putting mat; and also includes a driving assembly including a driving mat, and further including a tee being disposed upon the driving mat; and also includes a backboard assembly including an upright support structure being disposed upon the ground and also including a backboard mat which is mounted to the upright support structure; and further includes a regulation golf ball and a whiffle-type golf ball.

6 Claims, 5 Drawing Sheets

GOLF TRAINING GAME

BACKGROUND OF THE INVENTION

1. Field of the Invention

The present invention relates to golf learning games and more particularly pertains to a new golf training game for improving one's golf game and having fun while doing so.

2. Description of the Prior Art

The use of golf learning games is known in the prior art. More specifically, golf learning games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,934,704; Des. 407,458; 5,588,652; 3,464,703; 5,282,627; Des. 261,791; and Des. 83,508.

While these devices fulfill their respective, particular objectives and requirements, the aforementioned patents do not disclose a new golf training game. The prior art includes inventions having simulated putting turf and a cup into which a golf ball can be putted.

SUMMARY OF THE INVENTION

The general purpose of the present invention, which will be described subsequently in greater detail, is to provide a new golf training game which has many of the advantages of the golf learning games mentioned heretofore and many novel features that result in a new golf training game which is not anticipated, rendered obvious, suggested, or even implied by any of the prior art golf learning games, either alone or in any combination thereof. The present invention includes a height-adjustable base support member being disposed upon a ground; and also includes a putting mat being disposed upon the height-adjustable base support member and having a top surface; and further includes a cup being disposed in and depending from the putting mat; and also includes a flag member being removably disposed in the cup and extending outwardly therefrom; and further includes a fairway mat being removably disposed upon the putting mat; and also includes a driving assembly including a driving mat being removably situated a selected distance from the fairway mat, and further including a tee being disposed upon the driving mat; and also includes a backboard assembly including an upright support structure being disposed upon the ground and also including a backboard mat which is mounted to the upright support structure; and further includes a regulation golf ball for putting on the putting/chipping mat and a whiffle-type golf ball being covered with hook and loop fasteners for hitting against the backboard mat. None of the prior art includes the plurality of mats each providing a distinctive use for the user.

There has thus been outlined, rather broadly, the more important features of the golf training game in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new golf training game which has many of the advantages of the golf learning games mentioned heretofore and many novel features that result in a new golf training game which is not anticipated, rendered obvious, suggested, or even implied by any of the prior art golf learning games, either alone or in any combination thereof.

Still another object of the present invention is to provide a new golf training game for improving one's golf game and having fun while doing so.

Still yet another object of the present invention is to provide a new golf training game that is easy and convenient to set up and use.

Even still another object of the present invention is to provide a new golf training game that greatly simulates actually playing the game of golf.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
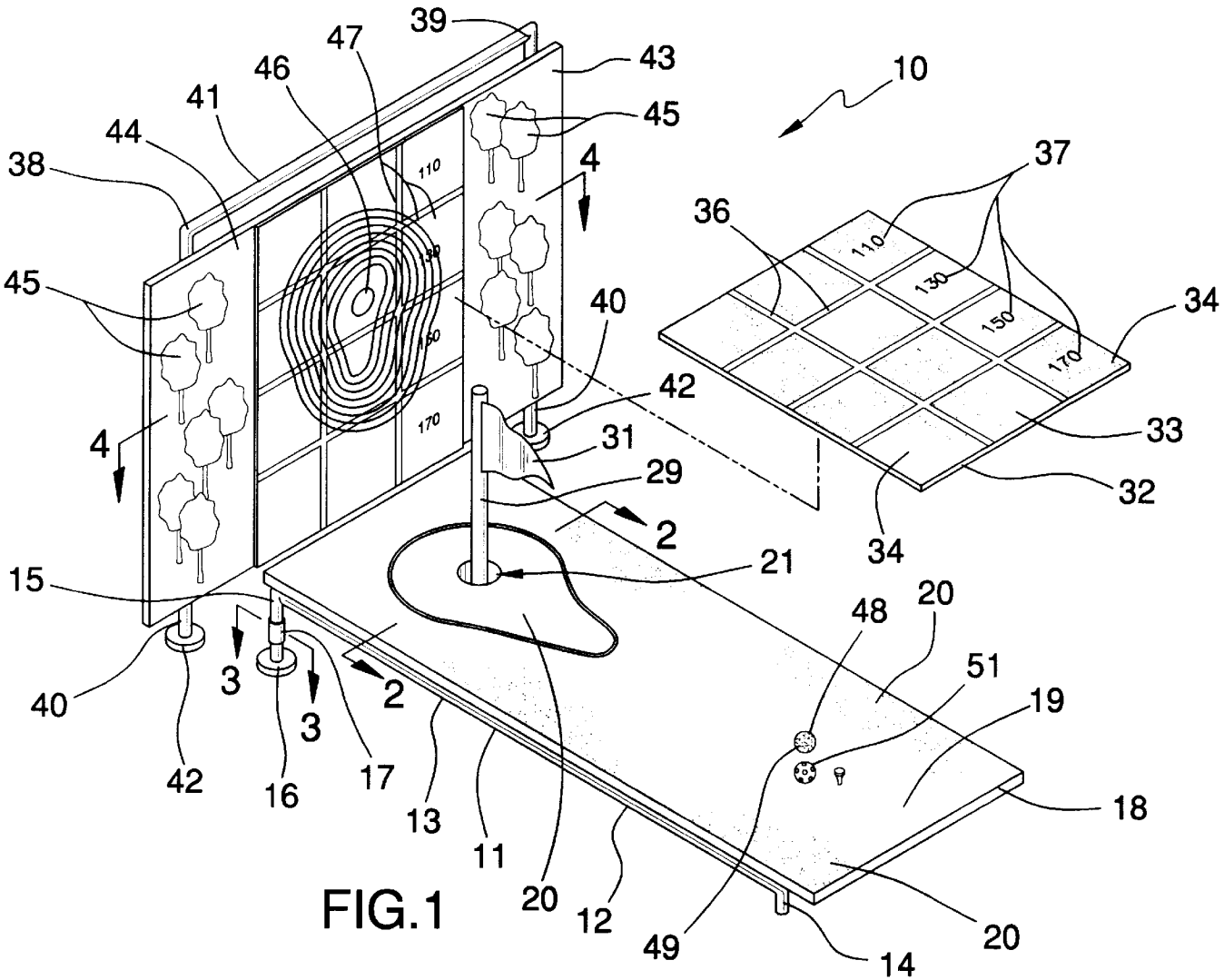
FIG. 1 is a perspective view of a new golf training game according to the present invention.
Figure 2:
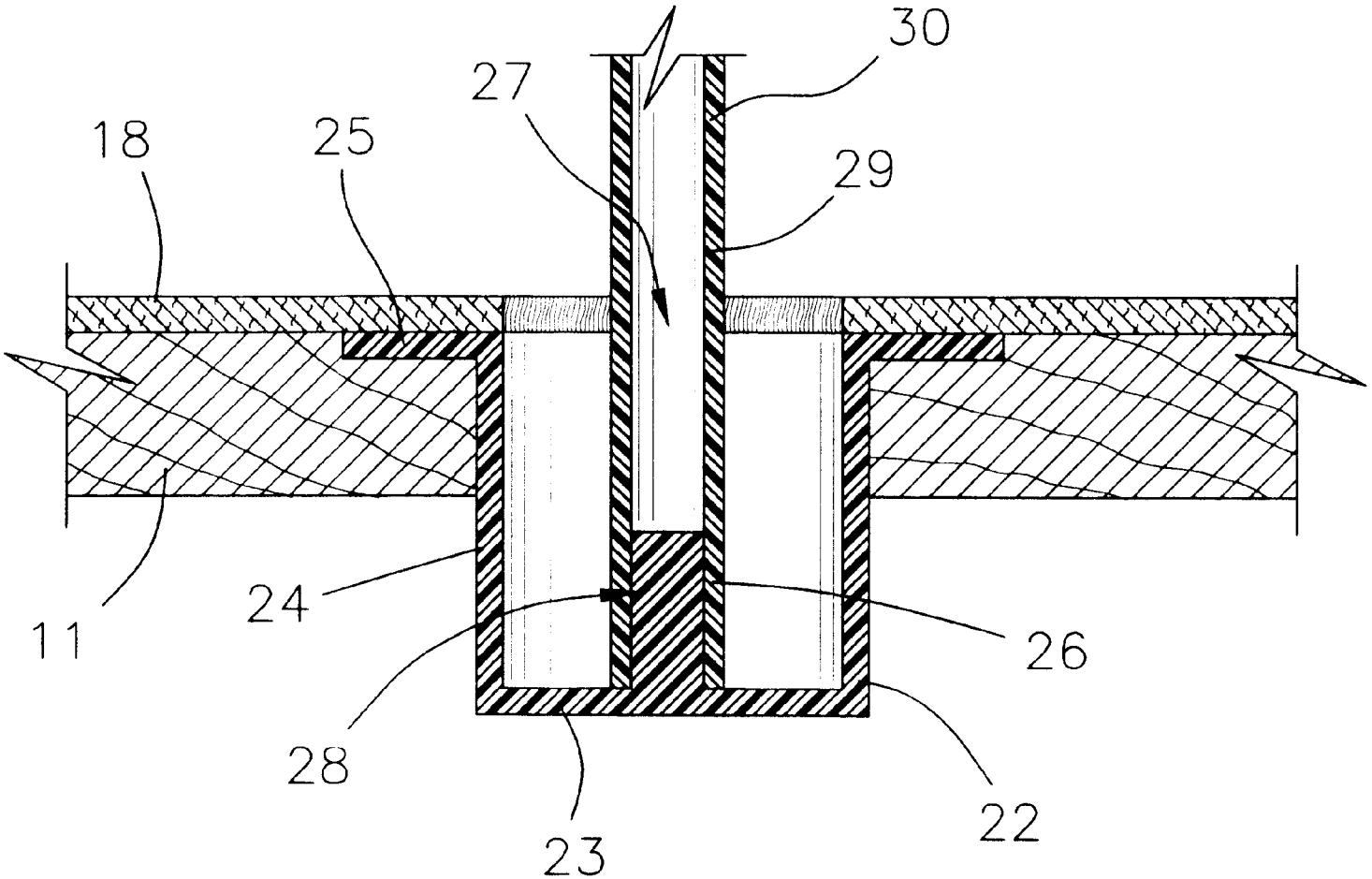
FIG. 2 is a cross-sectional view of the floor mat of the present invention.
Figure 3:
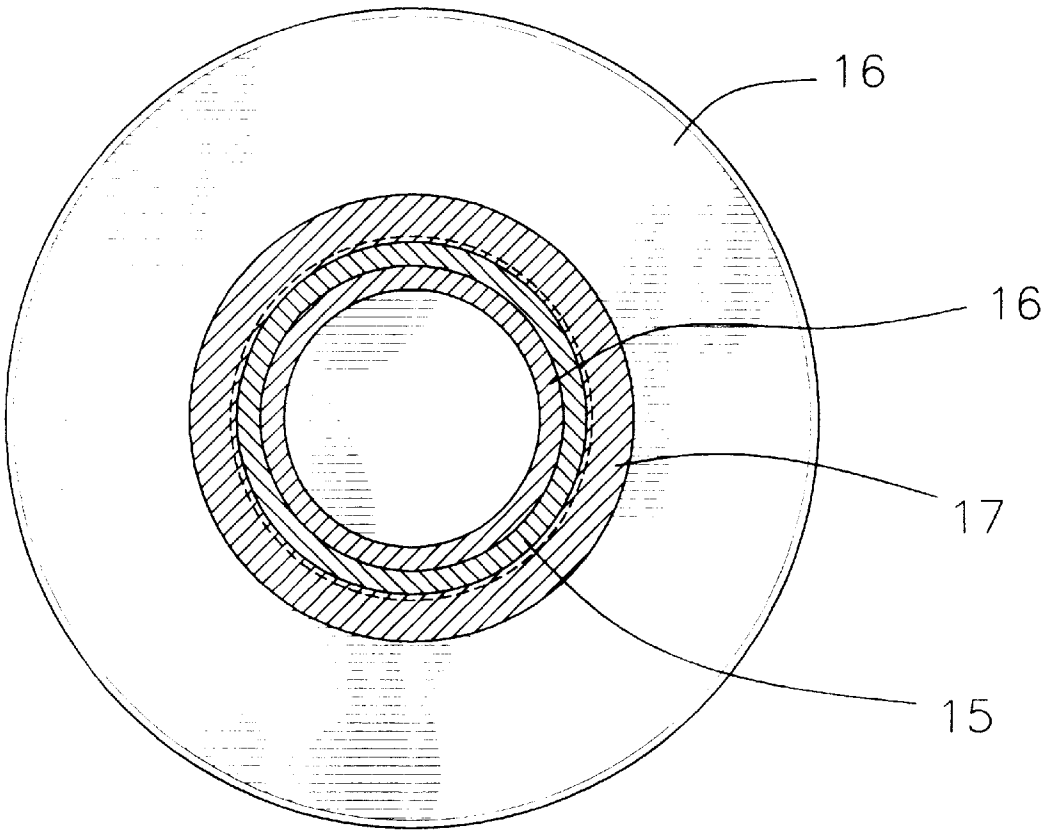
FIG. 3 is a partial cross-sectional view of the height-adjustable support member of the present invention.
Figure 4:
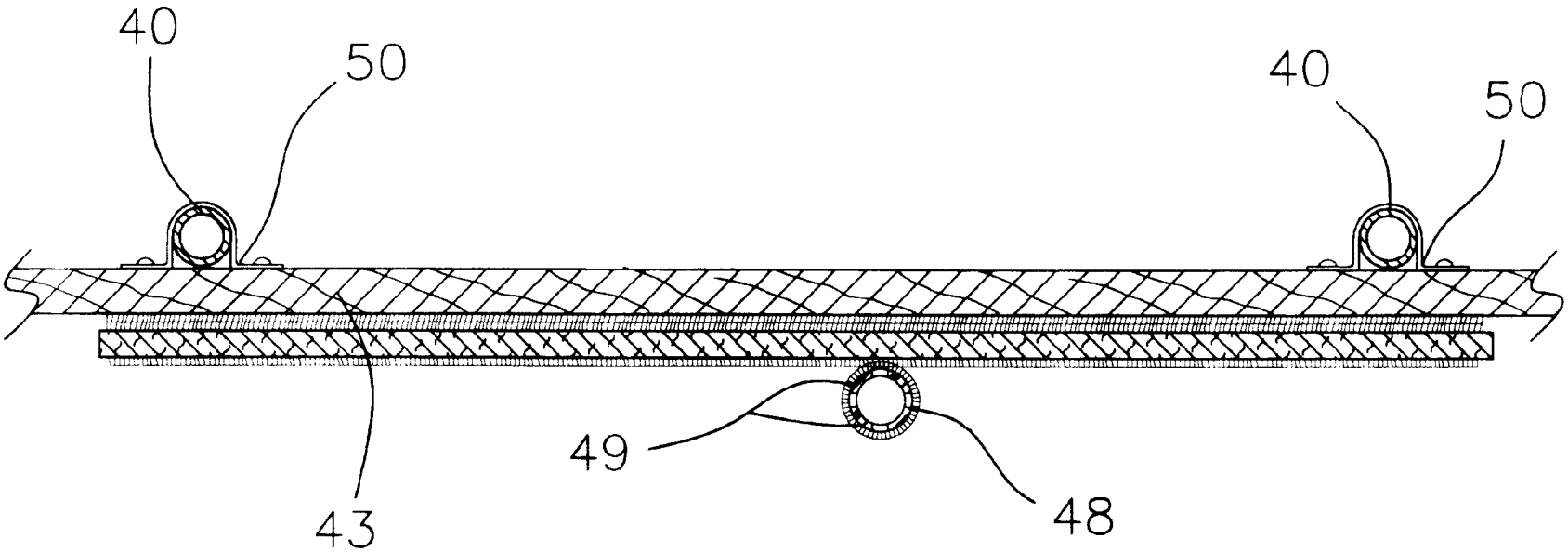
FIG. 4 is a cross-sectional view of the backboard assembly of the present invention.
Figure 5:
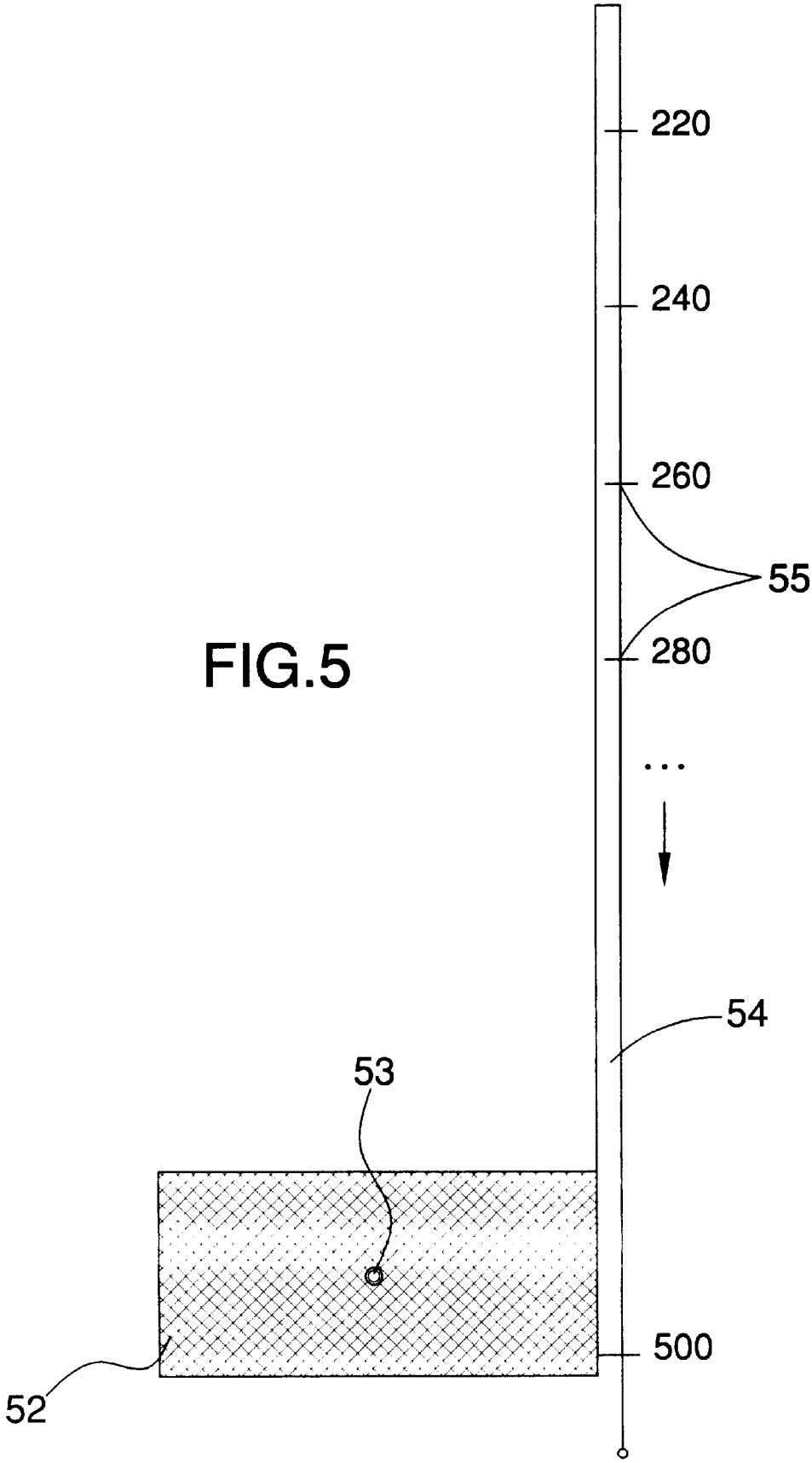
FIG. 5 is a top plan view of the driving assembly of the present invention.

With reference now to the drawings, and in particular to FIGS. 1 through 5 thereof, a new golf training game embodying the principles and concepts of the present invention and generally designated by the reference numeral 10 will be described.

As best illustrated in FIGS. 1 through 5, the golf training game 10 generally comprises a height-adjustable base support member 11 being disposed upon a ground. The height-adjustable base support member 11 includes elongate shafts 12 each having a main portion 13 and curved front and back end portions 14, 15, and also includes at least foot members 16 being conventionally connected to the curved back end portions 15, and further includes height adjustment couplers 17 interconnecting the foot members 16 and the curved back end portions 15 and being movable relative to the foot members 16 and to the curved back end portions 15 for raising and lowering the curved back end portions 15 relative to the foot members 16. The height adjustment couplers 17 are sleeves.

A putting/chipping mat 18 is conventionally disposed upon the height-adjustable base support member 11 and has a top surface. The putting/chipping mat 18 includes a low-cut pile carpet 20 being conventionally disposed upon the top surface thereof and simulating a golf green and putting surface, and also includes intermediate-cut pile carpet 19 being conventionally disposed about the low-cut pile carpet 20 and simulating the fringe of the golf green, and further includes a hole 21 being extended through the putting/chipping mat 18 and the low-cut pile carpet 20 near the back end.

A cup 22 is conventionally disposed in and depending from the putting/chipping mat 18. The cup 22 includes bottom and side walls 23, 24, and also includes an annular lip 25 being integrally disposed at a top of the side wall 24 and extending outwardly therefrom, and further includes a tubular flag support member 26 being conventionally disposed in the cup 22 and being conventionally attached to the bottom wall 23 and having an open top end 27 and a bore 28 extending therein. A flag member 29 is removably disposed in the cup 22 and extends outwardly therefrom. The flag member 29 includes a pole 30 being removably engaged in the bore 28 of the tubular support member 26 of the cup 22, and also includes a flag 31 being conventionally attached near a top end of the pole 30.

A fairway mat 32 is removably positioned adjacent the putting/chipping mat 18. The fairway mat 32 includes a top surface, and also includes a second strip of low-cut pile carpet 33 being conventionally disposed upon the top surface thereof and being centrally-extended from a back end to a front end of the fairway mat 32 and simulating a fairway, and further includes second strips of high-cut pile carpet 34 being conventionally disposed to either side of the first strip of the low-cut pile carpet 33 and simulating rough. The fairway mat 32 further includes line markings 36 being conventionally displayed upon the top surface thereof and arranged to form a grid pattern of rows and columns with one of the columns having numbers 37 being conventionally displayed thereupon with the numbers 37 representing yardage distance to a simulated green.

A driving assembly includes a driving mat 52 being removably situated a selected distance from the fairway mat 32, and also includes a tee 53 being disposed upon the driving mat 53. A flexible distance indicator 54 having simulated yardage markings 55 spacedly displayed thereupon is securely and conventionally attached to the driving mat 52 and is extendable therefrom to adjustably position the driving mat 52 from the fairway mat 32 in correlation to yards of a particular golf hole on a golf course.

A backboard assembly includes an upright support structure 38 being conventionally disposed upon the ground and also including a backboard mat 43 which is conventionally mounted to the upright support structure 38. The upright support structure 38 includes a tubular stand 39 having feet 42 which is adapted to allow the tubular stand 39 to stand upright upon the ground with the tubular stand 39 including elongate leg portions 40 and an elongate cross portion 41 integrally interconnecting the elongate leg portions 40. The backboard mat 43 is conventionally mounted to the tubular stand 38 with bracket members 50 and has a front side 44, and also has a central portion extending from a top edge to a bottom edge thereof, and further has side portions extending from the top edge to the bottom edge thereof and being disposed to either side of the central portion, and also has a plurality of pictures of trees 45 being conventionally displayed upon the side portions of the front side 44 of the backboard mat 43 to simulate woods lining a particular golf hole with the central portion simulating a fairway of the particular golf hole. The backboard mat 43 further includes a picture of a golf green 46 being conventionally displayed upon the front side 44 and near a top of the central portion, and also includes a plurality of concentric rings 47 being conventionally displayed upon the central portion of the front side 44 with the concentric rings 47 simulating and designating yardage distance from the golf green 46.

A regulation golf ball 51 and a whiffle-type golf ball 48 being conventionally covered with hook and loop fasteners 49 are used to play the golf training game 10 with the regulation golf ball 51 being used to put on the putting/chipping mat 18, and the whiffle-type golf ball 48 being hit with a golf club against the backboard mat 43.

In use, a user would place the wiffle-type golf ball on a tee 53 and would hit the wiffle-type golf ball 48 towards the backboard mat 43 upon which the wiffle-type golf 48 would stick. The user would then note the placement of the wiffle-type golf ball 48 upon the backboard mat 43 and would place the wiffle-type golf ball 48 on a corresponding place upon the fairway mat 32 and would use a golf club to again hit the wiffle-type golf ball 48 towards the simulated green upon the backboard mat 43. The user would then use a regulation golf ball 51 and either chip or putt upon the putting/chipping mat 18 to get the regulation golf ball 51 in the cup 22.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the golf training game. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf training game comprising:

a height-adjustable base support member being disposed upon a ground, said height-adjustable base support member including at least one elongate shaft having a main portion and curved front and back end portions, and also including at least one foot member being connected to said curved back end portion, and further including at least one height adjustment coupler interconnecting said at least one foot member and said curved back end portion and being movable relative to said at least one foot member and to said curved back end portion for raising and lowering said curved back end portion relative to said at least one foot member;

a putting/chipping mat being disposed upon said height-adjustable base support member and having a top surface;

a cup being disposed in and depending from said putting mat;

a flag member being removably disposed in said cup and extending outwardly therefrom;

a fairway mat being removably disposed adjacent to said putting/chipping mat;

a driving assembly including a driving mat being removably situated a selected distance from said fairway mat, and also including a tee being disposed upon said driving mat;

a backboard assembly including an upright support structure being disposed upon the ground and also including a backboard mat which is mounted to said upright support structure; and a regulation golf ball for putting on said putting/chipping mat and a whiffle-type golf ball being covered with hook and loop fasteners for hitting against said backboard mat from said tee and from said fairway mat.

2. A golf training game as described in claim 1, wherein said at least one height adjustment coupler is a sleeve.

3. A golf training game comprising:

a height-adjustable base support member being disposed upon a ground;

a putting/chipping mat being disposed upon said height-adjustable base support member and having a top surface, said putting/chipping mat including low-cut pile carpet being disposed upon said top surface thereof and simulating a golf green and a putting surface, and also including intermediate-cut pile carpet being disposed about said low-cut pile carpet and simulating the fringe of the golf green, and further including a hole being extended through said putting/chipping mat and said low-cut pile carpet near a back end;

a cup being disposed in and depending from said putting mat;

a flag member being removably disposed in said cup and extending outwardly therefrom;

a fairway mat being removably disposed adjacent to said putting/chipping mat;

a driving assembly including a driving mat being removably situated a selected distance from said fairway mat, and also including a tee being disposed upon said driving mat;

a backboard assembly including an upright support structure being disposed upon the ground and also including a backboard mat which is mounted to said upright support structure; and a regulation golf ball for putting on said putting/chipping mat and a whiffle-type golf ball being covered with hook and loop fasteners for hitting against said backboard mat from said tee and from said fairway mat.

4. A golf training game comprising:

a height-adjustable base support member being disposed upon a ground;

a putting/chipping mat being disposed upon said height-adjustable base support member and having a top surface;

a cup being disposed in and depending from said putting mat;

a flag member being removably disposed in said cup and extending outwardly therefrom;

a fairway mat being removably disposed adjacent to said putting/chipping mat, said fairway mat including a top surface, and also including a second strip of low-cut pile carpet being disposed upon said top surface thereof and being centrally-extended from a back end to a front end of said fairway mat and simulating a fairway, and further including second strips of high-cut pile carpet being disposed to either side of said first strip of said low-cut pile carpet and simulating rough;

a driving assembly including a driving mat being removably situated a selected distance from said fairway mat, and also including a tee being disposed upon said driving mat;

a backboard assembly including an upright support structure being disposed upon the ground and also including a backboard mat which is mounted to said upright support structure; and a regulation golf ball for putting on said putting/chipping mat and a whiffle-type golf ball being covered with hook and loop fasteners for hitting against said backboard mat from said tee and from said fairway mat.

5. A golf training game as described in claim 4, wherein said fairway mat further includes line markings being displayed upon said top surface thereof and arranged to form a grid pattern of rows and columns with one of said columns having numbers displayed thereupon with said numbers representing yardage distance to a simulated green.

6. A golf training game as described in claim 4, wherein said driving assembly further includes a flexible distance indicator having simulated yardage markings spacedly displayed thereupon, said flexible distance indicator being securely attached to said driving mat and being extendable therefrom to adjustably position said driving mat from said fairway mat in correlation to yards of a particular golf hole on a golf course.

* * * * *